US007344456B2

(12) United States Patent
Hayton

(10) Patent No.: US 7,344,456 B2
(45) Date of Patent: Mar. 18, 2008

(54) FLEXIBLE GOLF TEE

(76) Inventor: Paul J. Hayton, 30 Hale Road, Unit 2, Brampton, Ontario (CA) L6W 4N9

( * ) Notice: Subject to any disclaimer, the term of this patent is extended or adjusted under 35 U.S.C. 154(b) by 0 days.

(21) Appl. No.: 10/983,595

(22) Filed: Nov. 9, 2004

(65) Prior Publication Data

US 2006/0100039 A1 May 11, 2006

(51) Int. Cl.
*A63B 57/00* (2006.01)

(52) U.S. Cl. ..... 473/396; 473/401

(58) Field of Classification Search ..... 473/386–403, 473/417, 420; D21/717, 718
See application file for complete search history.

(56) References Cited

U.S. PATENT DOCUMENTS

| | | | | |
|---|---|---|---|---|
| D82,059 | S * | 9/1930 | Sargent | D21/718 |
| 2,839,304 | A * | 6/1958 | Lerick | 473/397 |
| 2,884,250 | A * | 4/1959 | Patterson | 473/423 |
| 3,438,578 | A | 4/1969 | Peterson et al. | |
| 3,489,411 | A * | 1/1970 | Morelli et al. | 473/417 |
| 3,858,878 | A * | 1/1975 | Tassone | 473/417 |
| 4,516,780 | A * | 5/1985 | Tabet | 473/398 |
| 4,524,974 | A | 6/1985 | Matsuura | |
| 4,778,053 | A | 10/1988 | Hakansson | |
| 5,242,170 | A | 9/1993 | Ward | |
| 5,772,536 | A * | 6/1998 | Wang | 473/417 |
| 6,053,822 | A | 4/2000 | Kolodney et al. | |
| 6,110,060 | A * | 8/2000 | Spoto | 473/396 |
| 6,341,752 | B1 | 1/2002 | Green | |
| 6,783,470 | B2 | 8/2004 | Lee | |

FOREIGN PATENT DOCUMENTS

| | | | |
|---|---|---|---|
| JP | 2005-185340 A * | 7/2005 | |

* cited by examiner

*Primary Examiner*—Steven Wong
(74) *Attorney, Agent, or Firm*—Gowan Intellectual Property

(57) ABSTRACT

A golf tee is provided which is reversably extendable from a collapsed state to an extended state in order to adjust the overall length of the golf tee. The tee comprises a stem section for insertion into the ground, a head section on which a golf ball can be placed, and an intermediate section have a concertina-like shape that can be reversably moved from the collapsed to the extended state. The intermediate section of the tee is also preferably bendable so that the head section will easily move out of the way as it is struck by the golf club. A low cost golf tee having enhanced features is provided.

17 Claims, 3 Drawing Sheets

Fig. 4
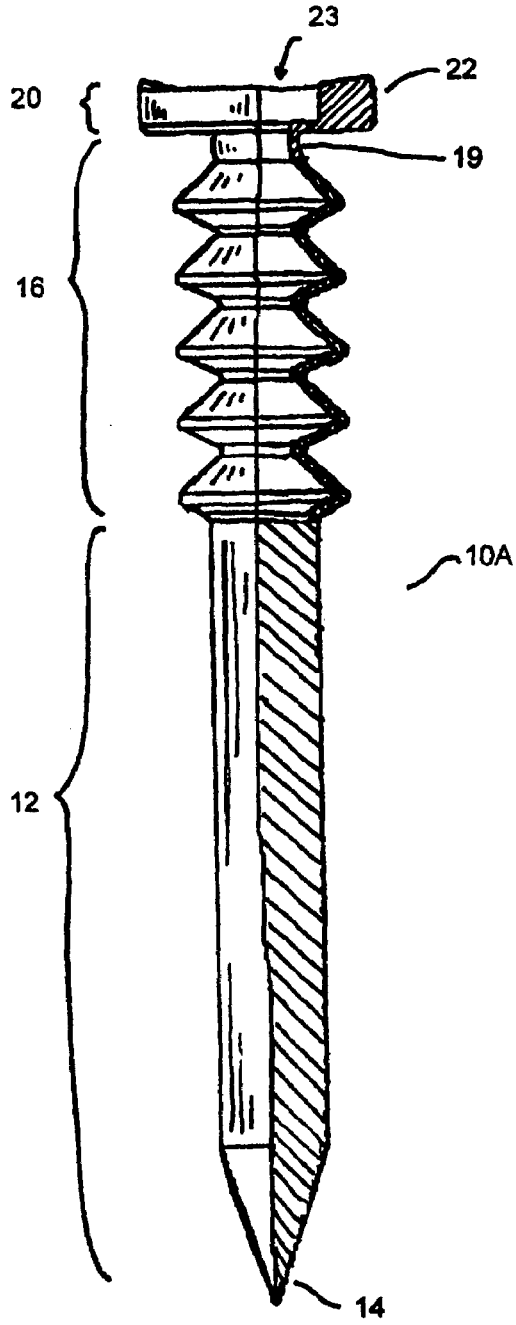
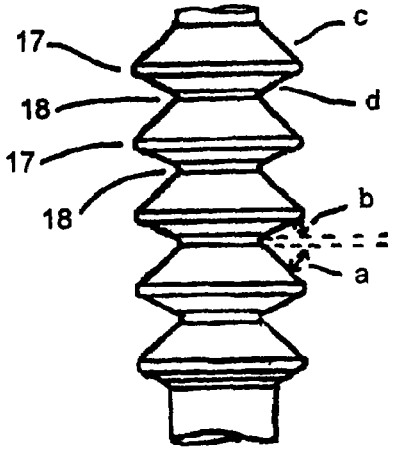
Fig. 5
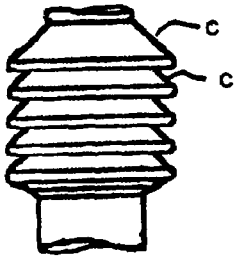
Fig. 6

FLEXIBLE GOLF TEE

FIELD OF THE INVENTION

The present invention relates to golf apparatus and equipment used in playing the game of golf on a golf course and/or practising golf on or off a golf course. In particular, the present invention relates to an improved golf tee used for teeing a golf ball during golf play and/or golf practice.

BACKGROUND OF THE INVENTION

When playing the game of golf, it is usual to start the game from the teeing ground of the hole on the golf course being played. When driving a golf ball from the teeing ground, most golf players (hereinafter referred to as "golfers") tee the golf ball, using a golf tee. This is permitted by the rules of play for golf as set by, for example, the United States Golf Association. The purpose of teeing the golf ball is to raise and support the golf ball off the ground, when driving, or stroking the golf ball with a golf club. A golf tee is used in playing the game of golf and in practising golf, especially on golf ball driving ranges and the like.

Previously, the golf tee used for teeing a golf ball, was a device or apparatus, usually made of wood or plastic, which was about 5 centimetres in length defined by a head and connecting stem. The stem of the tee was, for the most part, 3 to 6 mm in diameter and terminated in a point at one end. The point was adapted to aid in inserting the tee into the ground. At the other end of the stem the diameter increased generally to about 1 cm in diameter, to define the head of the tee. The head of the tee had an upper surface which was slightly concave, such as a dish-like surface, adapted to support a golf ball.

When inserting the tee into the ground it is not unusual when using clubs commonly designated as "irons" to drive the tee substantially completely into the ground so that the head of the tee is substantially at ground level. As such, the golf ball would rest at a level essentially the same as the grass surface. When using clubs commonly designated as "woods" (or "metals"), and particularly with modern day 1 woods (also known as "drivers"), it is desirable to have the golf ball held at a height of 2 to 6 cm, or even more, above the ground. As a result, tees of extended length of up to 8 cm or more, are now commonly used. In this instance, the stem of the tee is only partially inserted into the ground, and two, four or even more centimetres of the tee is left exposed above the ground.

When hit with a golf club travelling at speeds of approximately 100 miles per hour, it is not uncommon for the exposed area of the tee to be broken. Further, when a tee is used with an iron, it is not always practical or possible to insert the tee 6 to 8 cm into the ground.

As a result, modern golfers commonly carry tees of different lengths in order to select a proper height for the selected shot. Alternatively, the player will search for broken tees left lying on the ground in order to tee the ball for an iron shot, and only use an intact tee for shots made with the driver. This can delay the game while the golfer searches for broken tees.

Also, with the larger tees, the cost of a constant supply of tees that are easily broken is no longer insignificant.

One possible solution to this problem has been the use of hard plastic tees which are not easily broken. However, most golfers do not favour these tees since they can, when inserted into hard ground, cause an undesirable impact felt by the golfer through the club when the club hits the tee. In some instances, the tee can be hard enough to also cause damage to the golf club or the golf club face on impact.

A recent solution to this problem is the use of so-called "brush" tees typically having a pointed stem portion for insertion into the ground connect to a base section which holds a number of vertical brush bristles commonly arranged in a circular pattern. The stem is inserted into the ground until the base section contacts the ground, and the golf ball is placed on the top of the brush bristles. When the ball is struck by the club, the bristles bend to allow the club to pass, and then return to an upright position. This avoids breakage of the tee, and permits the club to pass without any significant loss of energy or feeling of impact to the golfer of the club striking the tee.

However, the heigh of these brush tees is not easily modified, and therefore, the golfer needs to carry a number of tees for different tee heights. Some golfers notice extremely small variations in ball height on the tee, and it is not always possible to locate or position a brush tee to hold the ball at the correct height.

Further, the brushes will wear over time, and will ultimately fail to hold the golf ball in position. Finally, the cost of brush tees are fairly substantial. As such, they have not been readily adopted by the golfing industry.

Accordingly, there remains a need for a golf tee which is resistant to breakage, and which is adjustable to be used at a variety of different heights. Further, it would be desirable to provide an improved tee which would be competitive in price with currently used wood tees.

SUMMARY OF THE INVENTION

The advantages set out hereinabove, as well as other objects and goals inherent thereto, are at least partially or fully provided by the golf tee of the present invention, as set out herein below.

Accordingly, in one aspect, the present invention provides a golf tee comprising a stem section for insertion into the ground, a ball-support head section on which a golf ball can be rested, and an intermediate section located between the stem and head sections, which intermediate section comprises a preferably bendable, and semi-rigid, concertina-like section having a series of ridges and grooves which allow the intermediate section to be reversably moved from a collapsed state to an extended state.

As a result, in contrast to the prior art, the present invention provides an improved golf tee which is essentially unbreakable and reusable, and which has the features of being both bendable and extendable. The tee therefore can be adapted for setting the golf ball at any desired height, provides little resistance to the club when the golf ball is hit, and is bendable to avoid breakage of the tee when impacted by the club. Consequently, the golfer needs only to carry one tee which is adaptable for use with any club, and which tee is unlikely to be easily broken in normal use.

Further, the golf tee can manufactured so that it can be "collapsed" to a length which is equal to or less than prior art wooden tees, so that the tee of the present invention can be conveniently carried in the pocket of a player or of a golf bag, if desired.

At this length, the tee can be inserted essentially completely into the ground for use with iron shots. However, the same tee can also be used, in its extended state, for shots needing a longer tee with a longer length. As such, the same tee is thus also suitable for use with a wood, or with a driver. After use in its extended state, the tee can be collapsed back to its shorter length for storage. As such, the tee of the present invention is easily adapted for use with different clubs, and is easily stored and transported. Further, because of the flexible, and preferably bendable, nature of the intermediate section, it is resistant to damage caused by the impact of the golf club since it will preferably merely bend to move out of the way with essentially no resistance to the club.

DETAILED DESCRIPTION OF THE INVENTION

It is to be noted that the golf tee of the present invention may be used when playing the game of golf and may also be used in the practice of driving, stroking or hitting a golf ball with a golf club, and as such, is useable in all of the current common uses of a prior art golf tee.

The various components of the golf tee of the present invention may be manufactured from a variety of materials, or a combination of a number of different materials, such as wood, metal, ceramic and plastic. For example, the head or stem sections might be manufactured from harder materials such as wood, metal, ceramic or hard plastic materials. These could then be joined to the intermediate section which would be manufactured from a more flexible, yet resilient material such as plastic. However, other materials such as a thin metal intermediate section would also be possible.

Preferably, however, the tee is produced as a one-piece item which is manufactured from a plastic material, such as polyethylene, polypropylene or the like, or combinations thereof and therebetween. Other plastic materials such as nylon, or the like, or rubber materials might also be used for various components or for the complete structure.

In its most preferred form, however, the golf tee is manufactured as a one-piece item made from a plastic material such as polyethylene, and is manufactured as an injection and/or blow molded component. The tee may be a solid component, but for reduced material cost, and increased flexibility, the tee is preferably hollow or has hollow sections, notably in the intermediate section. As such, the tee preferably has a thin wall structure around a hollow interior. This thin walled structure is particularly preferred in the concertina-like section of the intermediate section.

The concertina-like section may be formed during the injection molding, for example, or might also be formed by other techniques such as, for example, inserting a previously straight tubular structure into a suitable press to form the concertina-like structure.

As such, it a further aspect, the present invention also provides a process for the production of a golf tee comprising injection or blow mold extrusion of a golf tee, said golf tee comprising a stem section for insertion into the ground, a ball-support head section on which a golf ball can be rested, and an intermediate section located between the stem and head sections, which intermediate section comprises a semi-rigid, concertina-like section having a series of ridges and grooves which allow the intermediate section to be reversably moved from a collapsed state to an extended state, and allowing said golf tee structure to cool.

Alternatively, the present invention provides a process for the production of a golf tee comprising injection or blow mold extrusion of a golf tee, said golf tee comprising a stem section for insertion into the ground, a ball-support head section on which a golf ball can be rested, and tubular intermediate section located between the stem and head sections, and subsequently pressing and heating said tubular intermediate section in a press to form an intermediate section having a semi-rigid, concertina-like section having a series of ridges and grooves which allow the intermediate section to be reversably moved from a collapsed state to an extended state, and allowing said golf tee structure to cool.

Although the actual size of the tee can vary depending on the selected design parameters, the tee of the present invention preferably has a collapsed length of between 1 and 4 cm, and more preferably, a collapsed length of between 1.5 and 3 cm. Further, the tee of the present invention preferably has an extended length of between 3 cm and 10 cm, and more preferably, an extended length of between 4 cm and 8 cm.

The diameter of the stem section is preferably typical of prior art wood tees, and thus will preferably have a diameter of from 3 to 6 mm. The diameter of the head section is also preferably typical of prior art wood tees. As such, the preferred diameter of the head section will be in the range of from 5 to 10 mm.

BRIEF DESCRIPTION OF THE DRAWINGS

Embodiments of this invention will now be described by way of example only in association with the accompanying drawings in which:

FIG. 4 is a partial cut-away drawing showing a cross-sectional portion of a golf tee of the present invention;

FIG. 5 is a drawing showing the angles of the concertina-like section in an extended state;

FIG. 6 is a partial cut-away drawing showing a cross-sectional portion of the concertina-like section in a collapsed state.

DETAILED DESCRIPTION OF THE DRAWINGS

Figure 1:
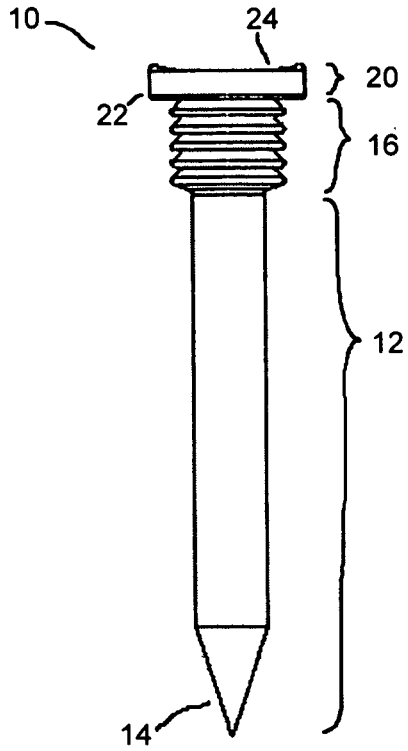
FIG. 1 is a drawing of a preferred golf tee according to the present invention with the intermediate section in a "collapsed" state.

The novel features which are believed to be characteristic of the present invention, as to its structure, organization, use and method of operation, together with further objectives and advantages thereof, will be better understood from the following drawings in which a presently preferred embodiment of the invention will now be illustrated by way of example only. In the drawings, like reference numerals depict like elements.

It is expressly understood, however, that the drawings are for the purpose of illustration and description only and are not intended as a definition of the limits of the invention.

Referring to FIG. 1, a golf tee 10 according to the present invention is shown in its collapsed state. The tee 10 is manufactured as a one-piece, injection molded item, which is made of polyethylene. At one end is a stem section 12 having a pointed end 14 to aid in insertion of tee 10 into the ground. At the opposite end is a ball-support head section 20 having a outwardly flanged section 22 which provides a surface 24 on which to rest a golf ball (not shown).

Intermediate of head section 20 and stem section 12 is intermediate section 16 having a concertina-like section which is shown in its collapsed state. The concertina-like section of intermediate section 16 can be collapsed or partially or fully extended, as described hereinbelow.

When used in the collapsed state, tee 10 is easily inserted into the ground, and is suitable for use with an iron or other golf club where it is desired to tee the ball low to the ground.

Figure 2:
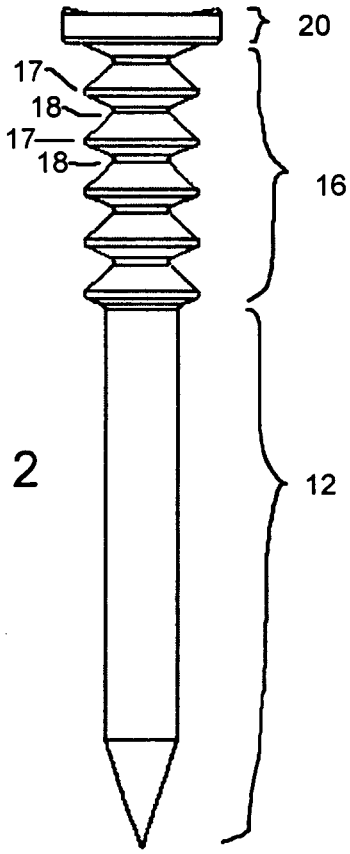
FIG. 2 is a drawing of the golf tee of FIG. 1 in an "extended" state.

In FIG. 2, the same tee 10 is shown when intermediate section 16 is now in its fully extended state. In this drawing, the concertina-like section is clearly visible, and consists of a series of ridges 17 and grooves 18 that can be moved from the collapsed condition to the extended state by pulling on head section 20. It will be clear to the skilled artisan, though, that intermediate section 16 can be fully extended, as shown in FIG. 2, or can be partially extended (not shown) in order to control the height of use of tee 10. Also, it should also be noted, that intermediate section 16 can be used to bend the tee to a non-linear shape, and thus can be used to assist in providing a level lie for the golf ball on head section 20 even when the surrounding ground is not level, or stem section 12 has not been inserted straight into the ground.

As such, for this purpose, intermediate section 16 provides a flexible, bendable assembly, that is preferably manufactured from a continuous series of ridges and grooves that create bellows-like pleats throughout, and substantially the length thereof, of the concertina-like section. This design enables the intermediate section to be easily moved, extended and/or bent to a variety of positions.

In use, tee 10 may be inserted into the ground in its collapsed state, as shown in FIG. 1, and then the intermediate section extended to be partially or fully extended, as shown in FIG. 2. Alternatively, tee 10 can be partially or fully extended prior to insertion of stem section 12 into the ground, and then intermediate section 16 can be further extended or collapsed to adjust the resting height of the golf ball. This enables the golfer to control the height of the ball for use with clubs such as a driver or the like, wherein a higher ball position is usually desired.

Figure 3:
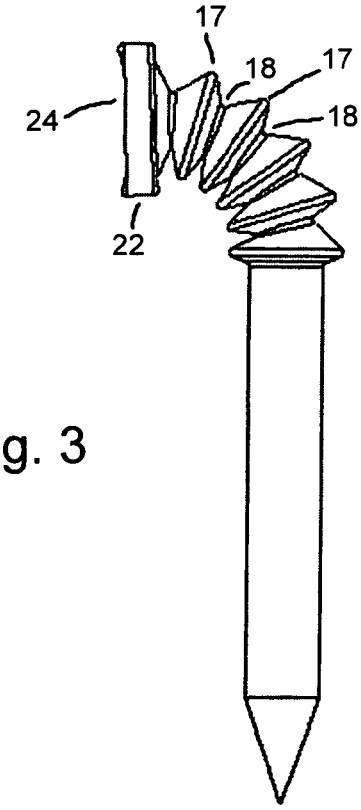
FIG. 3 is a drawing of the golf tee of FIG. 2 after impact of a golf club on the golf tee.

In FIG. 3, the golf tee shown in FIG. 2, is shown in a bent state after impact of a golf club with a golf ball, and thus also after impact with tee 10. During impact, intermediate section 16 easily bends as a result of the impact, and as such, causes little resistance to the golf club as it passes. From the bent condition shown in FIG. 3, the intermediate section 16 is straightened, and then can be returned to the collapsed state where it can be stored until needed again.

In FIG. 4, a partial cross-sectional view of a second variant 10B of the golf tee of the present invention is shown in its extended state. In this view, it can be seen that tee 10 is essentially hollow in the concertina-like section of intermediate section 16. Stem section 12 is a solid mass, and is preferred in order to provide maximum strength for insertion of tee 10B into the ground. Pointed end 14 is preferably provided in order to facilitate insertion of said stem section into the ground.

Stem section 12 might also be constructed to include grooves or ridges in order to provide a stronger grip to the ground when inserted, in order to minimize the possibility of pulling the tee out of the ground when intermediate section 16 is moved from its collapsed state to its extended state.

Head section 20 is shown with a opening 23 surrounded by solid flange section 22. This configuration allows a golf ball (not shown) to rest on top of flange section 22, while partially extending into opening 23. Alternatively, head section 20 might also comprise a concave surface on which the golf ball can rest, and/or might additionally comprise a head section shaped more like a traditional golf tee head section. However, for ease of production, the design shown in FIG. 4 is preferred.

Head section 20 is preferably located immediately adjacent to intermediate section 16. However, an additional stem section 19, as shown in this variant, might be included as part of the head section, immediately between flange section 22, and intermediate section 16.

It should be noted that head section 20 is designed to provide sufficient structural strength to hold the golf ball without causing the collapse of the head section. Further, head section 20 also preferably has sufficient strength to allow it to be impacted by a golf club without permanent damage to head section 20. As a result, head section 20 would be expected to also have sufficient strength to enable it to be used for pulling or pushing in order to extend or collapse intermediate section 16.

The wall thickness in intermediate section 16 should not be large enough to interfere with the operation of the concertina-like section, but should be strong enough to avoid collapsing, and provide adequate support when the golf ball is place on the head section. A constant wall thickness is preferred in this section, although different wall thicknesses might be used.

Obviously, the number of concertina-like sections can be varied from the 5 sections shown in FIG. 4. Preferably, however, the number of concertina-like section will number between 2 and 8, and more preferably, between 3 and 6.

In FIG. 5, an enlarged view of intermediate section 16 is shown wherein details of a preferred construction of the ridges 17 and grooves 18 are shown. In its extended state, "projection" angle "a" is preferably about 45° (± about 10°), and "return" angle "b" is preferably about 22.5° (± about 10°). With this configuration, the intermediate section can be collapsed and extended, and most importantly, will maintain the collapsed or extended shape, as desired. The ability to maintain the collapsed or extended state is a preferred feature of the present invention, however, other angles for "a" and "b" will also be acceptable depending on the desired design features of the tee. Those familiar with the design of, for example, flexible and extendable drinking straws will be able to determine acceptable angles for proper function. However, preferably angle "a" is between 20 and 70°, and more preferably between 30 and 60°, and angle "b" is between 5 and 45°, and more preferably between 10 and 35°.

Also, sections "c" and "d", which can be termed as the "projection portions" and the "return portions" respectively, preferably have lengths of between 1 and 10 mm, and can be the same length. More preferably, however, lengths "c" and "d" will be between 2 and 5 mm. Typically, length "d" will be greater than length "c", however, increasing the value of length of the return portion, "c", provides the greatest increase in the extended length.

It should also be noted that the concertina-like section of intermediate section 16 is shown having a "downward" facing orientation, in that each section of the concertina-like section collapses into the bottom part of the concertina-like section above it. A mirror-image, upward facing orientation could also be adopted, and would be equally useable.

In FIG. 6, a partial, cut-away cross-sectional view of the same part of intermediate section 16 is shown, but in this case, intermediate section 16 is shown in its collapsed state. It will be clear that lengths "c" and "d" will remain constant, and that angle "a" has also remain constant. However, angle "b" has changed.

It should also be noted that depending on the design of the golf tee of the present invention, the concertina-like section of intermediate section 16 may extend into the hollow section when in a collapsed state. For simplicity, it is preferred that the tee be designed so that the concertina-like section partially fill the hollow section within intermediate section 16, when collapsed. Preferably, however, the concertina-like section may extend into the hollow section of intermediate section 16 so as to almost completely fill the hollow section. However, it is clearly preferred that the concertina-like sections not extend to the point where there is interference from the opposite wall section.

Those skilled in this art will be aware that by controlling lengths "c" and "d", by controlling angles "a" and "b", and further by controlling the number of ridges and grooves in intermediate section 16, the overall collapsed and extended length of intermediate section 16 can thus be controlled. Using these parameters, it is preferred that the intermediate section is designed so as to provide a collapsed intermediate section length of between 0.5 and 3 cm, and an extended length of between 2 and 6 cm.

By way of example, in the golf tees exemplified in the drawings, the overall length in the collapsed state, shown in FIG. 1 is 3.0 cm. The length of the intermediate section is 0.5 cm. When in the extended state, as shown in FIG. 2, the overall length is 3.8 cm, and the length of the intermediate section is 1.2 cm. With this arrangement, the ratio of extended to collapsed length of the intermediate section is approximately 3:1. This ratio can vary depending on the design parameters, but preferably is in the range of from 1.5:1 to 5:1, and more preferably, is in the range of from 2:1 to 4:1.

Again, however, all of these design parameters are easily modified by the skilled artisan, and as such, the overall length can be easily modified by modification of the length of the stem section, the head section or the intermediate section.

Figure 7:
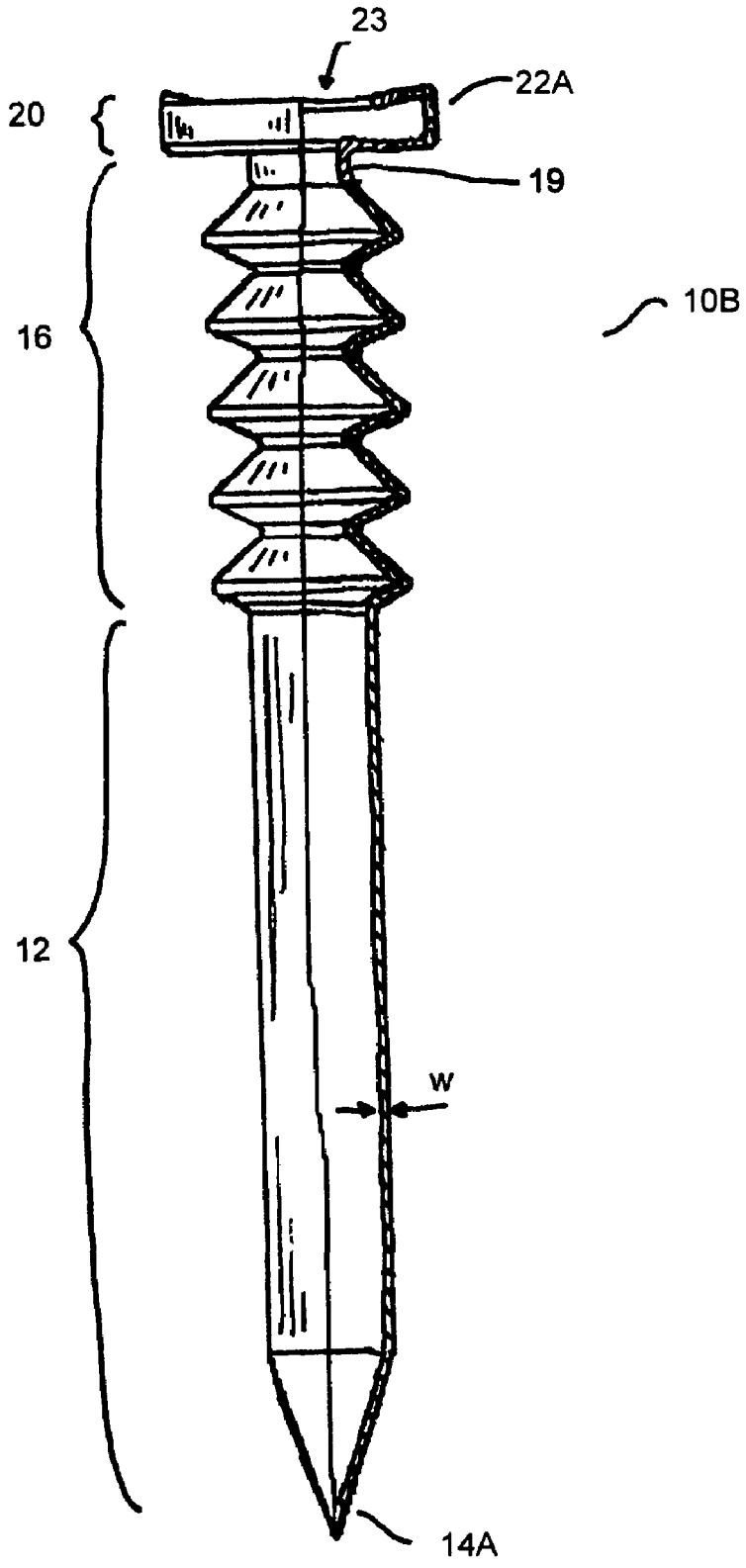
FIG. 7 is a partial cut-away drawing showing a cross-sectional portion of a further golf tee of the present invention.

In FIG. 7, a third variant 10B of the golf tee of the present invention is shown in a partial cut-away drawing similar to FIG. 4. However, in this variant, tee 10B has a stem section 12 and a flange 22A in head section 20, that are essentially hollow in order to minimize the amount of product used during production, while still providing adequate strength. Tee 10B is shown with an essentially constant wall thickness (w), although the wall thickness might be varied if desired to provide, for example, additional strength to selected areas. Depending on the material of construction, and the strength properties that are desired, the wall thickness of the golf tee preferably is within the range of from 0.1 mm to 10 mm, and more preferably within the range of from 0.5 mm to 5 mm.

It should be noted that while the golf tee of the present invention has been described herein as being made of, for example, a plastic material such polyethylene, for environmental reasons, the golf tee of the present invention might be made of new or recycled plastic materials or combinations thereof. Further, the golf tee of the present invention might be made of biodegradable materials, such as, for example, biodegradable plastics.

Additionally, other components can be added to the golf tee of the present device including for example, such as directional indicators (which might be removal) to act as alignment aids during practice applications (for example), or additional flanges or shaped features to facilitate insertion or removal of the tee from the ground. Further, it should be noted that the tee of the present invention can be produced from coloured materials, or from a multi-colour design, and therefore, minimizes or eliminates the need for painting of a wooden tee, for example. Further, the tee of the present application provides surfaces suitable for the insertion of advertising material or messages, or the like.

Thus, it is apparent that there has been provided, in accordance with the present invention, a golf tee which fully satisfies the goals, objects, and advantages set forth herein-before. Therefore, having described specific embodiments of the present invention, it will be understood that alternatives, modifications and variations thereof may be suggested to those skilled in the art, and that it is intended that the present specification embrace all such alternatives, modifications and variations as fall within the scope of the appended claims.

Additionally, for clarity and unless otherwise stated, the word "comprise" and variations of the word such as "comprising" and "comprises", when used in the description and claims of the present specification, is not intended to exclude other additives, components, integers or steps.

Moreover, the words "substantially" or "essentially", when used with an adjective or adverb is intended to enhance the scope of the particular characteristic; e.g., "substantially planar" or "essentially planar" would be intended to mean planar, nearly planar and/or exhibiting characteristics associated with a planar element.

Further, use of the terms "he", "him", or "his", is not intended to be specifically directed to persons of the masculine gender, and could easily be read as "she", "her", or "hers", respectively.

Also, while this discussion has addressed prior art known to the inventor, it is not an admission that all art discussed is citable against the present application.

I claim:

1. A golf tee comprising a stem section having a pointed end for insertion into the ground, a ball-support head section on which a golf ball can be rested, and an intermediate section located between the stem and head sections, which intermediate section comprises a semi-rigid, horizontally bendable, concertina-like section having a series of ridges and grooves which allow the intermediate section to be reversably vertically moved from a collapsed state to an extended state in order to provide a golf tee capable of setting a golf ball at a desired height, and which intermediate section is horizontally bent on impact with a golf club and which remains in a bent condition after impact until straightened by the user.

2. A golf tee as claimed in claim 1 wherein said head and stem sections are manufactured from wood, metal, ceramic or plastic materials, and said intermediate section is manufactured from flexible plastic or metal material.

3. A golf tee as claimed in claim 1 wherein each of said stem section, said bead section and said intermediate section are produced from the same material.

4. A golf tee as claimed in claim 3 wherein said stem section, said head section and said intermediate section are produced as a one piece item, and are manufactured from polyethylene, polypropylene, nylon, rubber materials, or combinations thereof and therebetween.

5. A golf tee as claimed in claim 2 wherein any or all of said stem section, said head section or said intermediate section are manufactured from recycled plastic materials.

6. A golf tee as claimed in claim 2 wherein any or all of said stem section, said head section or said intermediate section are manufactured from biodegradable plastic.

7. A golf tee as claimed in claim 1 wherein said intermediate section is essentially hollow.

8. A golf tee as claimed in claim 7 wherein said intermediate section has a thin walled structure.

9. A golf tee as claimed in claim 1 wherein said stem section, a flange section of said head section, and said intermediate section are essentially hollow.

10. A golf tee as claimed in claim 1 wherein said intermediate section has a collapsed length of between 0.5 and 3 cm, and an extended length of between 2 and 6 cm.

11. A golf tee as claimed in claim 1 wherein said golf tee has a collapsed length of between 1 and 4 cm, and has an extended length of between 3 cm and 10 cm.

12. Use of a golf tee as claimed in claim 1 wherein said tee is used when playing the game of golf, or in practicing the driving, stroking or hitting of a golf ball with a golf club.

13. A golf tee as claimed in claim 1 wherein said head section comprises an outwardly flanged section and a inner opening within said flange, in order to provide a golf ball support.

14. A golf tee as claimed in claim 1 wherein said intermediate section has a series of ridges and grooves, and when in a collapsed state, said ridges and grooves have a projection angle "a" of between 30 and 60°, and a return angle "b" of between 10 and 35°.

15. A golf tee as claimed in claim 1 wherein said intermediate section has a series of ridges and grooves, and said ridges and grooves are formed from projection portions having a length of between 1 and 10 mm, and return portions having a length of between 2 and 5 mm.

16. A process for the production of a golf tee comprising injection or blow mold extrusion of a golf tee, said golf tee comprising a stem section for insertion into the ground, a ball-support head section on which a golf ball can be rested, and an intermediate section located between the stem and head sections, which intermediate section comprises a semi-rigid, horizontally bendable, concertina-like section having a series of ridges and grooves which allow the intermediate section to be reversably vertically moved from a collapsed state to an extended state, in order to provide a golf tee capable of setting a golf ball at a desired height and which intermediate section is horizontally bent on impact with a golf club and which remains in a bent condition after impact until straightened by the user, and allowing said golf tee structure to cool.

17. A process for the production of a golf tee comprising injection or blow mold extrusion of a golf tee, said golf tee comprising a stem section for in rtion into the ground, a ball-support head section on which a golf ball can be rested, and tubular intermediate section located between the stem and head sections, and subsequently pressing and heating said tubular intermediate section in a press to form an intermediate section having a semi-rigid, horizontally bendable, concertina-like section having a series of ridges and grooves which allow the intermediate section to be reversably vertically moved from a collapsed state to an extended state, in order to provide a golf tee capable of setting a golf ball at a desired height and which intermediate section is horizontally bent on impact with a golf club and which remains in a bent condition after impact until straightened by the user, and allowing said golf tee structure to cool.

* * * * *